US006622492B1

(12) United States Patent
Eyermann

(10) Patent No.: US 6,622,492 B1
(45) Date of Patent: Sep. 23, 2003

(54) APPARATUS AND PROCESS FOR VAPORIZING LIQUEFIED NATURAL GAS (LNG)

(76) Inventor: Volker Eyermann, 2111 Welch St., #B -321, Houston, TX (US) 77019

( * ) Notice: Subject to any disclaimer, the term of this patent is extended or adjusted under 35 U.S.C. 154(b) by 0 days.

(21) Appl. No.: 10/161,431

(22) Filed: Jun. 3, 2002

(51) Int. Cl.[7] ..... F17C 9/02
(52) U.S. Cl. ..... 62/50.2
(58) Field of Search ..... 62/50.2; 261/DIG. 11, 261/157, 152

(56) References Cited

U.S. PATENT DOCUMENTS 1,839,104 A * 12/1931 Lifur ..... 261/113
2,299,920 A * 10/1942 Moore ..... 261/30
3,658,123 A * 4/1972 Root ..... 165/207
4,055,050 A * 10/1977 Kozlov ..... 60/692
4,128,124 A * 12/1978 Worthington ..... 165/48.2
4,170,115 A 10/1979 Ooka et al.
4,224,802 A 9/1980 Ooka
4,287,019 A * 9/1981 Standiford ..... 159/2.3
4,331,129 A 5/1982 Hong et al.
4,399,660 A 8/1983 Vogler, Jr. et al.
4,590,770 A * 5/1986 Howard ..... 62/50.2
5,251,452 A 10/1993 Wieder
5,819,542 A 10/1998 Christiansen et al.
6,367,258 B1 * 4/2002 Wen et al. ..... 60/641.7

* cited by examiner

*Primary Examiner*—William C. Doerrler
(74) *Attorney, Agent, or Firm*—Harrison & Egbert

(57) ABSTRACT

An apparatus and process for vaporizing liquefied natural gas including the extraction of heat from ambient air to heat circulating water. The heat exchange process includes a heat exchanger for the vaporization of liquefied natural gas, a circulating water system, and a water tower extracting heat from the ambient air to heat the circulating water. To make the process work throughout the year the process may be supplemented by a submerged fired heater connected to the water tower basin.

10 Claims, 1 Drawing Sheet

APPARATUS AND PROCESS FOR VAPORIZING LIQUEFIED NATURAL GAS (LNG)

FIELD OF THE INVENTION

This invention relates to an apparatus and process for vaporizing liquefied natural gas, heated to ambient temperature suitable for use, for example to a temperature of 50° F. to 60° F.

BACKGROUND OF THE INVENTION

The evaporators presently in use in the USA are predominantly of the submerged combustion type, elsewhere in the world other types like open rack sea water type and intermediate fluid type are in use.

Evaporators of the submerged combustion type comprise a water bath in which the flue gas tube of a gas burner is installed as well as the exchanger tube bundle for the vaporization of the liquefied natural gas. The gas burner discharges the combustion flue gases into the water bath, which heat the water and provide the heat for the vaporization of the liquefied natural gas. The liquefied natural gas flows through the tube bundle. Evaporators of this type are reliable and of compact size, but they involve the use of fuel gas and thus are expensive to operate.

Open rack type evaporators use sea water as a heat source for the vaporization of liquefied natural gas. These evaporators use once-through seawater flow on the outside of a heat exchanger as the source of heat for the vaporization. They do not block up from freezing water, are easy to operate and maintain, but they are expensive to build. They are widely used in Japan. Their use in the USA and Europe is limited and economically difficult to justify for several reasons. First the present permitting environment does not allow returning the seawater to the sea at a very cold temperature because of environmental concerns for marine life. The present permitting environment allows only a small decrease in temperature before returning the seawater back to the sea, which would require a very large sea water quantity to be pumped through the system, if the terminal vaporization capacity was designed for a commercial size as economics would require. Also coastal waters like those of the southern USA are often not clean and contain a lot of suspended solids, which could require filtration. In addition the sea water intake structure would have to be located far away from the evaporators in most cases because of location restraints or to get to deep and clean sea water at the intake. With these restraints the use of open rack type vaporizers in the USA is environmentally and economically not feasible.

Evaporators of the intermediate fluid type use a refrigerant like Freon or Propane having a low temperature of solidification to transfer the heat from a warm water stream to the liquefied natural gas. This is achieved by heating the liquid refrigerant in a reboiler type exchanger with ambient once-through water in the tube bundle. The refrigerant vaporizes, condenses to liquid on the cold liquefied natural gas exchanger tubes located in the vapor space of the exchanger and falls back into the liquid refrigerant bath, where it is again vaporized. The heat of condensation of the refrigerant provides the heat of vaporization of the liquefied natural gas. These type vaporizers are less expensive to build, but have the same permitting restraints in the USA as the open rack types.

SUMMARY OF THE INVENTION

The main objective of this invention is to provide an apparatus and process for vaporizing liquefied natural gas, which utilizes ambient air to provide the heat for the vaporization process.

A further objective is to provide an apparatus and process to heat cooled water from a heat exchanger by ambient air for return to the heat exchanger.

An additional object of the invention is to provide a supplemental heater for heating the cooled water from the heat exchanger.

The above objects accomplish the extraction of heat from the environment for the vaporization of liquefied natural gas in large quantities and with the least effect on the environment and on marine and terrestrial life.

These and other objectives of this invention will become apparent from the following drawing description.

BRIEF DESCRIPTION OF THE INVENTION

Figure 1:
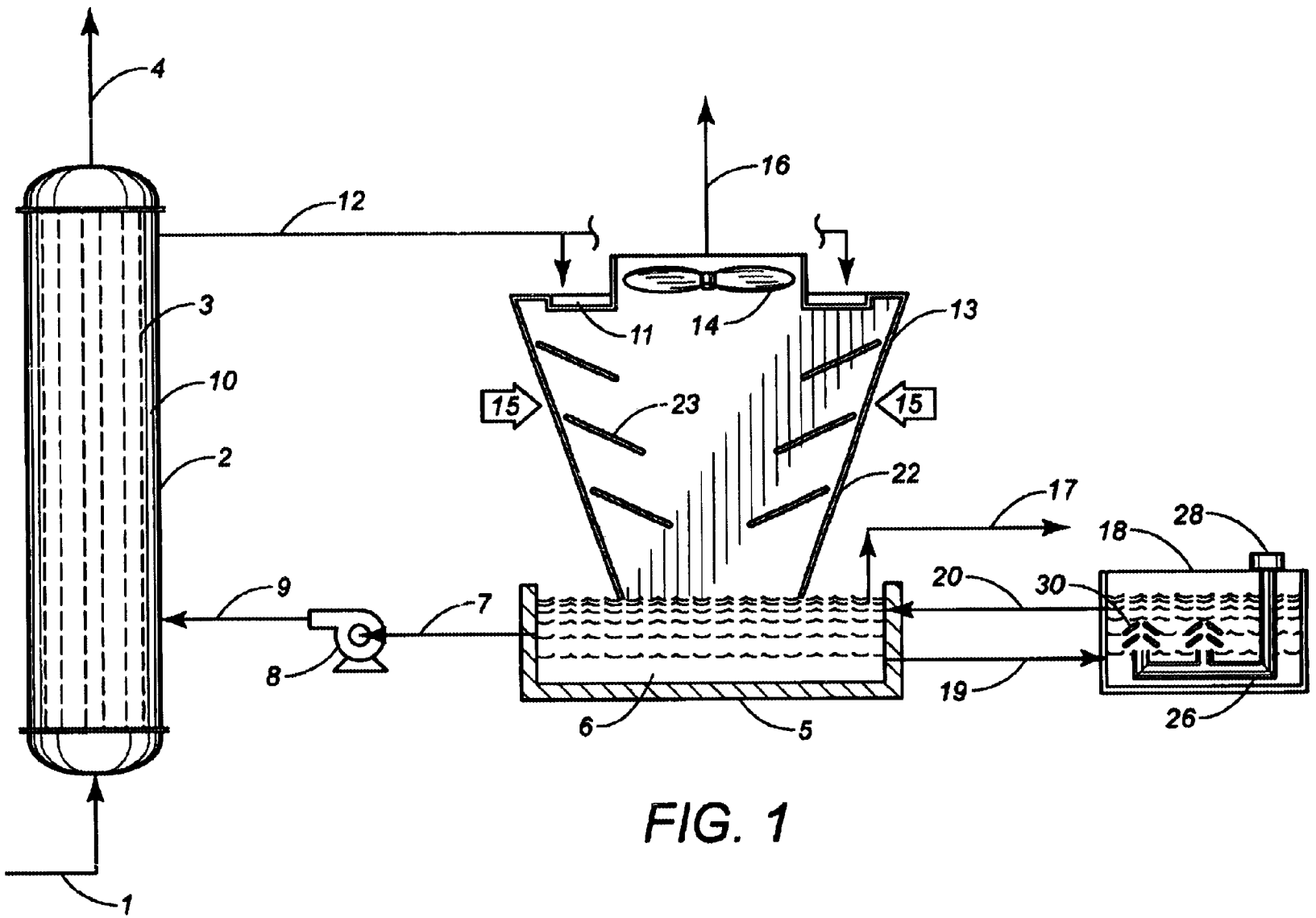
FIG. 1 is a schematic view of the process and associated apparatus utilized in the process.

The present invention provides an apparatus and process for vaporizing liquefied natural gas and comprises a circulating water stream, which is heated by ambient air and is used to vaporize the liquefied natural gas. The circulating water system comprises a surge basin for the storage of clean circulating water, several circulating water pumps, a vertical multi-tubular heat exchanger for bringing the warm circulating water into crosscurrent contact with the liquefied natural gas, and a water tower, which is used to warm the circulating water with ambient air. An important feature of this invention is the process to extract heat from the ambient air and to use it to vaporize liquid natural gas, using apparatus which includes a new combination of elements of proven equipment.

The invention will be described in more detail with reference to the drawing, whose only figure is a schematic view of the arrangement of the apparatus for carrying out the process according to this invention.

DETAILED DESCRIPTION OF PREFERRED EMBODIMENT

As indicated in FIG. 1, the apparatus and process according to the invention comprises a surge basin 5, a circulating water pump 8, a heat exchanger 2 and a water tower 13.

Liquefied natural gas 1 is directed to the bottom of the heat exchanger 2, where it enters tubes 3 of the tube side of the multi-tubular heat exchanger 2 through a proprietary distribution arrangement. The liquefied natural gas 1 is vaporized in the tubes 3 and leaves the heat exchanger as natural gas 4 at a temperature and pressure suitable for distribution in a pipeline system to the users.

Warm water 6 from the water surge basin or container 5 is directed through pipe 7 to the circulating water pump 8 and discharged through pipe 9 to the shell side 10 of the heat exchanger 2. The warm water 6 is directed in cross current flow on the outside of the tubes 3, thereby transferring the heat to the liquefied natural gas 1 and vaporizing it to natural gas 4.

Cold circulating water 11 leaves the shell side 10 of the heat exchanger 2 via pipe 12 and is directed to the top distribution channel of water tower 13. Water tower 13 has an outer frusto-conical wall 22 having perforations or openings therein for the flow of ambient air through wall 22. Baffles 23 are mounted in water tower 13 adjacent wall 22. Cold water 11 overflows an upper distribution tray or pan in water tower 13 in a controlled manner and cascades downwardly along baffles 23 into the lower water basin 5. Fan 14 draws warm ambient air 15 through openings in wall 22 of water tower 13 from the side of water tower 13, thereby warming up the water 11, which is cascading downwardly in water tower 13 and which arrives in surge water basin 5 as warm water 6. Cold water 11 cools the air 15 as it heats up to warm water 6, and cold air 16 is discharged by the fan 14 at the top of the water tower 13.

The heat exchanger 2 is a vertical so called shell-and-tube heat exchanger. It is in use in many installations and need not be modified for use in this process. The water tower 13 is used as a device to warm cold water. The use of water tower 13 to warm water is an important feature in this invention. Contrary to the application of the water tower as a cooling water tower to cool warm water, in which a water loss occurs continuously from vaporization of circulating water, there is no water loss in the present application. To the contrary, because the water is colder than the ambient air, water from the moisture of the air condenses and increases the water inventory continuously. The excess water has to be drawn off continuously as an overflow quantity 17 to control the system inventory and may be used as fresh water after very minimal water treatment.

Even in warm climates like that of the southern USA this process cannot work all year round because the air cools off in the months of November to March. In the winter season, at least partial supplemental firing of conventional submerged fired liquefied natural gas vaporizer(s) 18 is required to assure continuous operation throughout the year. These submerged fired heater(s) 18 having submerged combustion chambers 26 with gas furnaces 28 need to be modified to replace their internal liquefied natural gas exchanger tubes with internal baffles 30 to improve mixing of the flue gases with the circulating water. A pump internal to the submerged fired heaters 18 pumps warm water 19 from the basin 5 to the submerged fired heater 18 and returns additionally warmed water 20 back to the basin 5.

It will be obvious to one skilled in the art that the present invention can be made to work throughout the year with water heater 18.

The following table reflects several examples of computer simulations of the process as described in this invention.

What is claimed is:

1. An apparatus for the vaporization of liquefied natural gas comprising:

a heat exchange means having a liquefied natural gas inlet and a natural gas outlet, said heat exchanger means for circulating warm water in heat exchange relationship with the liquefied natural gas therein, said heat exchange means for discharging cold water therefrom;

a water tower having an upper end in fluid communication with said heat exchange means so as to receive the discharged cold water therefrom, said water tower having an upwardly extending outer wall, said outer wall having openings formed therein, said water tower having a plurality of baffles extending inwardly from said outer wall thereof; and a fan means positioned adjacent to said upper end of said water tower, said fan means for drawing ambient air through said openings of said outer wall into said water tower so that heat from the ambient air increases a temperature of the cold water as the cold water cascades downwardly over said plurality of baffles.

2. The apparatus of claim 1, further comprising:

a first water basin means positioned adjacent a lower end of said water tower, said first water basin means for receiving the water from said water tower as heated by the ambient air; and a water supply line means connected between said first water basin means and said heat exchanger means for supplying the heated water to said heat exchanger means.

3. The apparatus of claim 2, further comprising:

a water pump positioned in said water supply line means.

4. The apparatus of claim 2, further comprising:

a second water basin means positioned adjacent said first water basin means for receiving water from said first water basin means;

a water heater means cooperative with said second water basin means for heating the water in said second water basin means; and a water line means connected between said second water basin means and said first water basin means for

TABLE

| Description | Units | Nr. In FIG. | Example 1 | Example 2 | Example 3 | Example 4 |
|---|---|---|---|---|---|---|
| LNG Vaporizer | | 2 | | | | |
| Heat Transferred | MMBTU/hr | 2 | 580 | 580 | 580 | 580 |
| LNG Flow Rate | gal/minute | 1 | 7,940 | 7,940 | 7,940 | 7,940 |
| Natural Gas Flow Rate | MMSCF/day | 4 | 925 | 925 | 925 | 925 |
| LNG Temperature in | 0 | 1 | −256 | −256 | −256 | −256 |
| Natural Gas Temperature out | | 4 | 30 | 30 | 30 | 30 |
| Circul. Water Flow Rate | gal/minute | 9 | 38,682 | 46,418 | 46,418 | 46,418 |
| Circul. Water Temperature in | | 9 | 70 | 65 | 65 | 65 |
| Circul. Water Temperature out | | 12 | 40 | 40 | 40 | 40 |
| Water Tower | | 13 | | | | |
| Number of Tower Cells/Fans | | 14 | 6 | 6 | 6 | 6 |
| Tower Height | Feet | 13 | 54 | 54 | 54 | 54 |
| Air Temperature, Wet Bulb | | 15 | 79 | 79 | 76 | 73 |
| Air Temperature, Dry Bulb | | 15 | 93.9 | 93.9 | 90.3 | 86.8 |
| Air Temperature, Out | | 16 | 51.4 | 51.4 | 51.9 | 53.6 |
| Circul. Water Flow Rate | gal/minute | 7 | 38,682 | 46,418 | 46,418 | 46,418 |
| Circul. Water Temperature in | | 11 | 40 | 40 | 40 | 40 |
| Circul. Water Temperature out | | 7 | 70 | 65 | 65 | 65 |
| Heat Transferred | MMBTU/hr | 15 | 580 | 580 | 580 | 580 |
| Moisture Condensation | gal/hour | 17 | 33,393 | 33,393 | 31,923 | 27,890 |

supplying the heated water from said second water basin means to said first water basin means.

5. The apparatus of claim 4, said water heater means comprising a submerged fired water heater having a submerged combustion chamber and gas burners.

6. A process for vaporizing liquefied natural gas comprising:

passing liquefied natural gas into a heat exchanger;

flowing cold water from said heat exchanger downwardly over a plurality of baffles extending inwardly from an outer wall of a water tower, said outer wall of said water tower having openings formed therein;

drawing ambient air inwardly through said openings into said water tower by a fan positioned at an upper end of said water tower;

intermixing the drawn ambient air with the flowed cold water as the drawn air flows upwardly in the water tower so as to warm the cold water, said drawn ambient air having a temperature greater than a temperature of said flowed cold water;

passing the warmed water to said heat exchanger such that the warmed water is in heat exchange relationship with the liquefied natural gas in said heat exchanger;

vaporizing the liquified natural gas in the heat exchanger; and discharging the vaporized natural gas from said heat exchanger.

7. The process of claim 6, further comprising:

passing the cold water from said heat exchanger into a water tray positioned adjacent on upper end of said water tower; and overflowing the water tray with the cold water such that the overflowed water flows downwardly over said plurality of baffles in said water tower.

8. The process of claim 6, further comprising:

positioning a water container adjacent a lower end of said water tower so as to receive the warmed water from said water tower; and placing an overflow container so as to receive water from said water container.

9. The process of claim 6, further comprising:

positioning a water container adjacent to a lower end of said water tower so as to receive the water from and water tower; and heating the water in said water container.

10. The process of claim 9, said step of heating comprising:

heating the water in said water container with natural gas burners.

* * * * *